US011513448B2

(12) United States Patent
Hasegawa et al.

(10) Patent No.: US 11,513,448 B2
(45) Date of Patent: Nov. 29, 2022

(54) LIQUID DEVELOPER AND METHOD FOR MANUFACTURING LIQUID DEVELOPER

(71) Applicant: CANON KABUSHIKI KAISHA, Tokyo (JP)

(72) Inventors: Waka Hasegawa, Tokyo (JP); Ryo Natori, Tokyo (JP); Ayano Mashida, Kawasaki (JP); Junji Ito, Hiratsuka (JP); Yasuhiro Aichi, Tokyo (JP); Jun Shirakawa, Kawaguchi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/827,064

(22) Filed: Mar. 23, 2020

(65) Prior Publication Data

US 2020/0225599 A1 Jul. 16, 2020

Related U.S. Application Data

(63) Continuation of application No. PCT/JP2018/035833, filed on Sep. 27, 2018.

(30) Foreign Application Priority Data

Sep. 28, 2017 (JP) ..... JP2017-188258
Sep. 5, 2018 (JP) ..... JP2018-166337

(51) Int. Cl.
*G03G 9/125* (2006.01)
*G03G 9/135* (2006.01)
*G03G 9/087* (2006.01)

(52) U.S. Cl.
CPC ..... *G03G 9/125* (2013.01); *G03G 9/08797* (2013.01); *G03G 9/135* (2013.01)

(58) Field of Classification Search
CPC ..... G03G 9/12; G03G 9/13; G03G 9/131; G03G 9/132; G03G 9/135
See application file for complete search history.

(56) References Cited

U.S. PATENT DOCUMENTS 5,760,257 A 6/1998 Tanaka et al.
7,833,687 B2 11/2010 Kato et al.
(Continued)

FOREIGN PATENT DOCUMENTS

EP 1 884 834 2/2008
JP 3267714 3/2002
(Continued)

OTHER PUBLICATIONS

Translation of JP 2008-186002.*
(Continued)

*Primary Examiner* — Peter L Vajda
(74) *Attorney, Agent, or Firm* — Venable LLP

(57) ABSTRACT

Provided is a liquid developer containing a carrier liquid with an SP value of not more than 8.20, a toner particle that is insoluble in the carrier liquid, and a toner particle dispersing agent, wherein the toner particle contains a polyester resin with an acid value of from 5 mg KOH/g to 50 mg KOH/g, a number-average molecular weight of the polyester resin is from 3,500 to 20,000, the toner particle dispersing agent is a polymer having a primary amino group, an amine value of the polymer having the primary amino group is from 30 mg KOH/g to 200 mg KOH/g, and a ratio of a total number of acid groups in the polyester resin relative to a total number of amino groups in the polymer having the primary amino group is from 1.0 to 10.0.

8 Claims, 1 Drawing Sheet

(56) References Cited

U.S. PATENT DOCUMENTS

| | | | | |
|---|---|---|---|---|
| 7,960,085 | B2 | 6/2011 | Kawamura et al. | |
| 8,399,170 | B2 | 3/2013 | Iwase et al. | |
| 8,697,327 | B2 | 4/2014 | Shibata et al. | |
| 8,815,484 | B2 | 8/2014 | Tanaka et al. | |
| 9,057,970 | B2 | 6/2015 | Ida et al. | |
| 9,229,345 | B2 | 1/2016 | Ikeda et al. | |
| 9,348,247 | B2 | 5/2016 | Ida et al. | |
| 9,556,290 | B2 | 1/2017 | Nishiura et al. | |
| 9,715,187 | B2 | 7/2017 | Mukumoto et al. | |
| 9,740,118 | B2 | 8/2017 | Hasegawa et al. | |
| 9,766,568 | B2 | 9/2017 | Ito et al. | |
| 9,857,716 | B2 | 1/2018 | Natori et al. | |
| 9,880,482 | B2 | 1/2018 | Hasegawa et al. | |
| 9,891,546 | B2 | 2/2018 | Ito et al. | |
| 9,891,547 | B2 | 2/2018 | Tanabe et al. | |
| 9,897,936 | B2 | 2/2018 | Natori et al. | |
| 9,971,268 | B2 | 5/2018 | Tanabe et al. | |
| 10,175,597 | B2 | 1/2019 | Shirakawa et al. | |
| 10,234,784 | B2 | 3/2019 | Kamiyoshi et al. | |
| 10,372,053 | B2 | 8/2019 | Kabashima et al. | |
| 10,423,084 | B2 | 9/2019 | Aichi et al. | |
| 10,545,424 | B2 | 1/2020 | Hasegawa et al. | |
| 2010/0136474 | A1 | 6/2010 | Iwase et al. | |
| 2014/0356779 | A1 | 12/2014 | Hasegawa et al. | |
| 2014/0377697 | A1 | 12/2014 | Nishiura et al. | |
| 2015/0004539 | A1 | 1/2015 | Watanabe et al. | |
| 2016/0349656 | A1 * | 12/2016 | Hasegawa | G03G 9/132 |
| 2018/0046105 | A1 | 2/2018 | Tanabe et al. | |
| 2018/0059566 | A1 | 3/2018 | Tanabe et al. | |
| 2018/0143546 | A1 | 5/2018 | Hasegawa et al. | |
| 2018/0210362 | A1 | 7/2018 | Natori et al. | |
| 2018/0329333 | A1 | 11/2018 | Tokunaga et al. | |
| 2018/0348658 | A1 | 12/2018 | Tsuchida et al. | |
| 2019/0107794 | A1 | 4/2019 | Tokunaga et al. | |
| 2019/0271929 | A1 | 9/2019 | Shirakawa et al. | |

FOREIGN PATENT DOCUMENTS

| | | | | |
|---|---|---|---|---|
| JP | 2003-241439 | | 8/2003 | |
| JP | 2008-186002 | * | 8/2008 | G03G 9/08 |
| JP | 2014-038234 | | 2/2014 | |
| JP | 5538854 | | 7/2014 | |
| JP | 2016-224098 | | 12/2016 | |
| JP | 2016-224103 | | 12/2016 | |
| JP | 2016-224405 | | 12/2016 | |
| JP | 2017-016101 | | 1/2017 | |
| JP | 2017-134137 | | 8/2017 | |
| WO | 2006/126566 | | 11/2006 | |
| WO | 2007/000974 | | 1/2007 | |
| WO | 2007/000975 | | 1/2007 | |
| WO | 2007/108485 | | 9/2007 | |
| WO | 2018/097169 | | 5/2018 | |

OTHER PUBLICATIONS

Harazaki, "Coating Fundamentals and Engineering", Publisher: Processing Technology Study Group, ISBN-10: 4906451381, ISBN-13: 978-4906451388 (2010) English Translation of p. 53, Table 3.9 "Evaporation Energy and Molar Volume of Atoms or Atomic Groups by the Fedors Method".

* cited by examiner

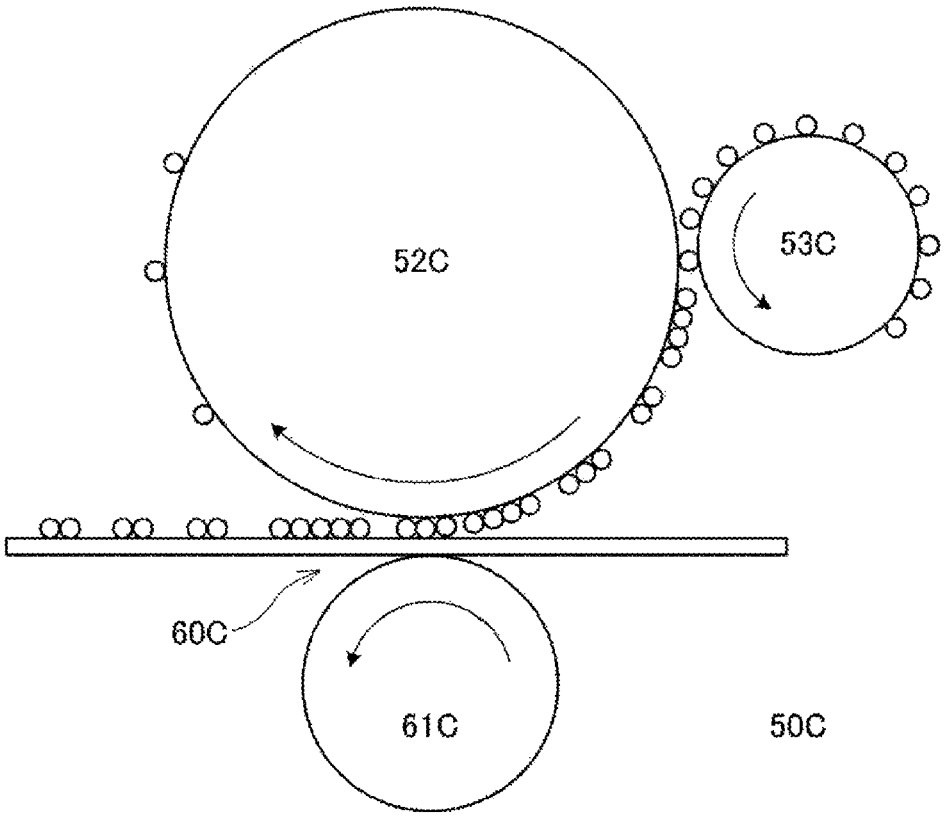
52C
53C
60C
61C
50C

LIQUID DEVELOPER AND METHOD FOR MANUFACTURING LIQUID DEVELOPER

CROSS-REFERENCE TO RELATED APPLICATIONS

This application is a Continuation of International Patent Application No. PCT/JP2018/035833, filed Sep. 27, 2018, which claims the benefits of Japanese Patent Application No. 2017-188258, filed Sep. 28, 2017, and Japanese Patent Application No. 2018-166337, filed Sep. 5, 2018, all of which are hereby incorporated by reference herein in their entirety.

BACKGROUND OF THE INVENTION

Field of the Invention

The present invention relates to a liquid developer for use in image-forming devices using electrophotographic systems such as electrophotographic methods, electrostatic recording methods and electrostatic printing, as well as a method for manufacturing the liquid developer.

Background Art

There has recently been increased demand for colorization in image-forming devices such as copiers, fax machines and printers that use electrophotographic methods. In particular, there has been active development of high-quality, high-speed printers that use electrophotographic techniques using liquid developers, which provide good reproducibility of fine line images, good gradation reproducibility and excellent color reproducibility, as well as excellent image formation at high speeds. Under these circumstances, there is demand for development of liquid developers having further improved characteristics.

A liquid developer having high electric resistivity and containing a high-mobility toner has already been developed (PTL 1).

Meanwhile, toner particle dispersing agents are commonly used to increase the dispersion stability of the toner particle, but toner particle dispersing agents can detract from toner mobility if they persist in the insulating liquid. Therefore, a technique has been developed for adsorbing and removing these with aluminum silicate and/or a magnesium oxide/aluminum oxide solid solution (PTL 2).

CITATION LIST

Patent Literature

PTL 1 Japanese Patent No. 3267714

PTL 2 Japanese Patent No. 5538854

However, the particle size of the toner in the liquid developer described in PTL 1 changes over time. Meanwhile, the technology disclosed in PTL 2 has problems of productivity.

The present invention provides a liquid developer having high volume resistivity of the liquid developer and containing a toner particle with a small particle diameter and excellent dispersion stability, along with a method for manufacturing the liquid developer.

SUMMARY OF THE INVENTION

The present invention is a liquid developer comprising: a carrier liquid with an SP value of not more than 8.20; a toner particle that is insoluble in the carrier liquid; and a toner particle dispersing agent, wherein the toner particle contains a polyester resin with an acid value of from 5 mg KOH/g to 50 mg KOH/g, a number-average molecular weight of the polyester resin is from 3,500 to 20,000, the toner particle dispersing agent is a polymer having a primary amino group, an amine value of the polymer having the primary amino group is from 30 mg KOH/g to 200 mg KOH/g, a ratio of a total number of acid groups in the polyester resin relative to a total number of amino groups in the polymer having the primary amino group is from 1.0 to 10.0, the polyester resin contains a monomer unit derived from an alcohol component and a monomer unit derived from an acid component, the monomer unit derived from the alcohol component includes a monomer unit derived from a $C_{2-12}$ aliphatic diol, a content of the monomer units derived from the $C_{2-12}$ aliphatic diol as a percentage of the monomer units derived from the alcohol component is from 40 mol % to 100 mol %, the monomer unit derived from the acid component includes a monomer unit derived from a $C_{8-12}$ aromatic dicarboxylic acid, and a content of the monomer units derived from the aromatic dicarboxylic acid having from 8 to 12 carbon atoms as a percentage of the monomer units derived from the acid component is from 75 mol % to 100 mol %.

The present invention is also a liquid developer manufacturing method for manufacturing the liquid developer, comprising:

a step (i) of preparing a resin-dispersed solution containing a polyester resin with an acid value of from 5 mg KOH/g to 50 mg KOH/g, a polymer having a primary amino group and an amine value of from 30 mg KOH/g to 200 mg KOH/g, and a solvent that dissolves the polyester resin;

a step (ii) of preparing a mixture containing the resin-dispersed solution and a carrier liquid with an SP value of not more than 8.20; and a step (iii) of distilling off the solvent from the mixture.

The present invention is also a liquid developer manufacturing method for manufacturing the liquid developer, comprising:

a step (I) of preparing a resin-dispersed solution containing a polyester resin with an acid value of from 5 mg KOH/g to 50 mg KOH/g, a polymer having a primary amino group and an amine value of from 30 mg KOH/g to 200 mg KOH/g, and a solvent that dissolves the polyester resin;

a step (II) of preparing a first mixture containing the resin-dispersed solution and a solvent other than a carrier liquid with an SP value of not more than 8.20 that does not dissolve the polyester resin;

a step (III) of removing the solvent that dissolves the polyester resin from the first mixture to prepare a toner particle dispersion; and a step (IV) of preparing a second mixture containing the toner particle dispersion and the carrier liquid.

Further features of the present invention will become apparent from the following description of exemplary embodiments with reference to the attached drawings.

BRIEF DESCRIPTION OF THE DRAWINGS

The FIGURE is a schematic view of a developing device.

DESCRIPTION OF THE EMBODIMENTS

Unless otherwise specified, descriptions of numerical ranges such as "at least XX and not more than YY" or "from XX to YY" in the present invention include the numbers at the upper and lower limits of the range.

Furthermore, a monomer unit is a reacted form of a monomer material in a polymer or resin.

The liquid developer of the present invention is a liquid developer containing a carrier liquid with an SP value of not more than 8.20, a toner particle that is insoluble in the carrier liquid, and a toner particle dispersing agent, wherein the toner particle contains a polyester resin with an acid value of from 5 mg KOH/g to 50 mg KOH/g, a number-average molecular weight of the polyester resin is from 3,500 to 20,000, the toner particle dispersing agent is a polymer having a primary amino group, an amine value of the polymer having the primary amino group is from 30 mg KOH/g to 200 mg KOH/g, and a ratio of a total number of acid groups in the polyester resin relative to the total number of amino groups in the polymer having the primary amino group is from 1.0 to 10.0.

The SP value is the solubility parameter. The SP value is a value introduced by Hildebrand and defined by regular theory. It is represented as the square root of the cohesive energy density of a solvent (or solute), and serves as a measure of the solubility of a two-component solution.

The SP values of the carrier liquid, polyester resin and polymer having a primary amino group in the present invention have been determined by calculation from the molar volume and evaporation energy of the atoms and atomic groups according to Fedors as described in *Coating no Kiso to Kougaku* (Coating Fundamentals and Engineering) (page 53, Yuki Harazaki, Converting Technical Institute). The SP values in the present invention are given in units of $(cal/cm^3)^{1/2}$, but may also be converted to units of $(J/m^3)^{1/2}$ using the formula 1 $(cal/cm^3)^{1/2}=2.046\times 10^3(J/m^3)^{1/2}$.

The materials are described in detail below.

The carrier liquid has an SP value of not more than 8.20.

An SP value of over 8.20 of the carrier liquid is inappropriate because the polyester resin becomes too soluble in the carrier liquid.

There is no particular lower limit to the SP value of the carrier liquid, but preferably it is at least 7.00, or more preferably at least 7.50.

The volume resistivity of the carrier liquid is preferably from $5\times10^8$ Ω·cm to $1\times10^{15}$ Ω·cm, or more preferably from $1\times10^9$ Ω·cm to $1\times10^{13}$ Ω·cm.

The viscosity of the carrier liquid is preferably at least 0.5 mPa·s and lower than 100 mPa·s or more preferably at least 0.5 mPa·s and lower than 20 mPa·s at 25° C.

Examples of the carrier liquid include hydrocarbon solvents such as octane, isooctane, decane, isodecane, decalin, nonane, dodecane and isododecane, and paraffin solvents such as Isopar E, Isopar G, Isopar H, Isopar L, Isopar M and Isopar V (Exxon Mobil Corporation), Shellsol A100 and Shellsol A150 (Shell Chemicals Japan Ltd.) and Moresco White MT-30P (Moresco Corporation) and the like.

To make the liquid developer into a curable liquid developer, a polymerizable liquid compound can be used for the carrier liquid. The polymerizable liquid compound is not particularly limited as long as it has the physical properties of the carrier liquid.

The polymerizable liquid compound may also be a component that can be polymerized by a photopolymerization reaction.

The photopolymerization reaction may be a reaction using any kind of light, but a reaction using ultraviolet light is preferred. That is, the insulating liquid may be a UV-curable polymerizable liquid compound.

Polymerizable liquid compounds including those that are radical polymerizable, those that are cationic polymerizable and those that are both, and any of these may be used favorably.

Examples include vinyl ether compounds, urethane compounds, styrene compounds and acrylic compounds, as well as cyclic ether compounds such as epoxy compounds and oxetane compounds. One kind of polymerizable liquid compound alone or a combination of two or more may be used.

The polymerizable liquid compound preferably includes a cationic polymerizable liquid monomer, and more preferably includes a vinyl ether compound.

Using this vinyl ether compound, it is possible to obtain a highly sensitive curable liquid developer with high volume resistivity and low viscosity.

A vinyl ether compound here means a compound having a vinyl ether structure (—CH═CH—O—C—).

This vinyl ether structure is preferably represented by R'—CH═CH—O—C— (in which R' is a hydrogen or $C_{1-3}$ alkyl group, and is preferably a hydrogen atom or methyl group).

The vinyl ether compound is preferably a compound represented by formula (b) below:

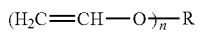

(b)

In formula (b), n represents the number of vinyl ether structures in one molecule, which is an integer from 1 to 4. R represents an n-valent hydrocarbon group.

Preferably, n is an integer from 1 to 3.

Preferably, R is a group selected from a linear or branched, saturated or unsaturated $C_{1-20}$ aliphatic hydrocarbon group, a saturated or unsaturated $C_{5-12}$ alicyclic hydrocarbon group and an $C_{6-14}$ aromatic hydrocarbon groups, in which the alicyclic hydrocarbon group and aromatic hydrocarbon group may also have saturated or unsaturated $C_{1-4}$ aliphatic hydrocarbon groups.

More preferably, R is a linear or branched saturated $C_{4-18}$ aliphatic hydrocarbon group.

Specific examples include dodecyl vinyl ether, dicyclopentadiene vinyl ether, cyclohexane dimethanol divinyl ether, tricyclodecane vinyl ether, dipropylene glycol divinyl ether, trimethylol propane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentyl glycol divinyl ether, pentaerythritol tetravinyl ether, 1,2-decanediol divinyl ether and the like.

The toner particle is insoluble in the carrier liquid.

A measure of "insoluble in the carrier liquid" may be that no more than 1 mass part of the toner particle dissolves in 100 mass parts of the carrier liquid at 25° C.

From the standpoint of obtaining high definition images, the volume-based 50% particle diameter (D50) of the toner particle is preferably from 0.05 μm to 2.0 μm, or more preferably from 0.05 μm to 1.2 μm, or still more preferably from 0.05 μm to 1.0 μm.

If the volume-based 50% particle diameter (D50) of the toner particle is within this range, not only can a toner image be formed with a sufficiently high resolution and image density from the liquid developer, but the thickness of the toner image can also be made sufficiently thin even in recording systems in which the carrier liquid remains on the recording medium.

The concentration of the toner particle in the liquid developer is preferably from 1 mass % to 50 mass % approximately, or more preferably from 2 mass % to 40 mass % approximately.

The toner particle contains a polyester resin with an acid value of at least 5 mg KOH/g.

If the acid value is less than 5 mg KOH/g, sufficient bonds are not formed with the amino groups of the toner particle dispersing agent, and the dispersion stability of the toner particle is reduced.

The minimum acid value is preferably at least 10 mg KOH/g, or more preferably 15 mg KOH/g or greater, or still more preferably 20 mg KOH/g or greater.

There is no particular maximum acid value, but preferably it is not more than 50 mg KOH/g, or more preferably not more than 40 mg KOH/g, or still more preferably not more than 30 mg KOH/g.

The acid value of the polyester resin can be controlled by controlling the number of terminal groups and the number of terminal groups that are carboxyl groups.

The SP value of the polyester resin with an acid value of at least 5 mg KOH/g is preferably from 9.00 to 15.00, or more preferably from 9.50 to 13.00.

The polyester resin may be a condensate of an alcohol monomer and a carboxylic acid monomer or the like.

Examples of the alcohol monomer include bisphenol A alkylene oxide adducts such as polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-2,2-bis(4-hydroxyphenyl) propane, polyoxypropylene(2.0)-polyoxyethylene(2.0)-2,2-bis(4-hydroxyphenyl) propane and polyoxypropylene(6)-2,2-bis(4-hydroxyphenyl) propane, and ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, bisphenol A, hydrogenated bisphenol A, glycerin, sorbitol, 1,2,3,6-hexanetetrol, 1,4-sorbitan, pentaerythritol, dipentaerythritol, tripentaerythritol, 1,2,4-butanetriol, 1,2,5-pentanetriol, 2-methylpropanetriol, 2-methyl-1,2,4-butanetriol, trimethylolethane, trimethylolpropane and 1,3,5-trihydroxymethyl benzene.

Examples of the carboxylic acid monomer include aromatic dicarboxylic acids such as phthalic acid, isophthalic acid and terephthalic acid, and their anhydrides; alkyldicarboxylic acids such as succinic acid, adipic acid, sebacic acid and azelaic acid, and their anhydrides; succinic acid substituted with $C_{6-18}$ alkyl groups or $C_{6-18}$ alkenyl groups, and anhydrides thereof; and unsaturated dicarboxylic acids such as fumaric acid, maleic acid and citraconic acid, and their anhydrides.

The following monomers may be also used: polyols, such as oxyalkylene ethers of novolac-type phenol resins; and polycarboxylic acids such as trimellitic acid, pyromellitic acid and benzophenontetracarboxylic acid, and their anhydrides.

Of these, either the carboxylic acid monomer or the alcohol monomer preferably has an aromatic ring. With an aromatic ring, it is possible to reduce the crystallinity of the polyester resin and improve solubility in the solvent.

The polyester resin with an acid value of at least 5 mg KOH/g has a number-average molecular weight (Mn) of at least 3,500.

The volume resistivity of the liquid developer is affected not only by the volume resistivity of the carrier liquid, but also by the concentration of binding products of the toner particle dispersing agent and the polyester resin, which are released from the toner particle into the carrier liquid. That is, the volume resistivity of the liquid developer is reduced if there is a high concentration of free binding products of the toner particle dispersing agent and the polyester resin in the carrier liquid.

If the number-average molecular weight (Mn) of the polyester resin with an acid value of at least 5 mg KOH/g is at least 3,500, the release of binding products of the toner particle dispersing agent and polyester resin into the carrier liquid is suppressed, and the concentration of binding products of the toner particle dispersing agent and polyester resin can be prevented from rising in the carrier liquid.

This is because the higher the molecular weight, the fewer the binding products of the toner particle dispersing agent and polyester resin that are released into the carrier liquid.

Moreover, the higher the ratio of the polyester resin in the binding products of the toner particle dispersing agent and polyester resin, the more the solubility behavior of the binding products of the toner particle dispersing agent and polyester resin in the carrier liquid resembles the solubility behavior of the polyester resin in the carrier liquid. Thus, it is thought that if the number-average molecular weight (Mn) of the polyester resin with an acid value of at least 5 mg KOH/g is at least 3,500, elution of binding products of the toner particle dispersing agent and polyester resin into the carrier liquid can be suppressed.

The number-average molecular weight has no particular upper limit, but is preferably not more than 20,000, or more preferably not more than 15,000.

The number-average molecular weight can be controlled by controlling the types of monomers used in the resin and the reaction conditions during resin synthesis.

The toner particle may also contain a resin other than the polyester resin with an acid value of at least 5 mg KOH/g as a resin component. Examples of this resin include vinyl resins, polyurethane resins, epoxy resins, polyamide resins, polyimide resins, silicon resins, phenol resins, melamine resins, urea resins, aniline resins, ionomer resins, polycarbonate resins and the like. Two or more of these resins may also be combined.

The content of the polyester resin with an acid value of at least 5 mg KOH/g as a percentage of the resin components in the toner particle is preferably from 50 mass % to 90 mass %, or more preferably from 50 mass % to 80 mass %.

This polyester resin preferably contains a monomer unit derived from an alcohol component and a monomer unit derived from an acid component.

The monomer unit derived from the alcohol component preferably include a monomer unit derived from a $C_{2-12}$ aliphatic diol.

The content of the monomer units derived from the aliphatic diol as a percentage of the monomer units derived from the alcohol component is preferably at least 40 mol %, or at least 50 mol %, or at least 60 mol %, or at least 70 mol %. The percentage content is also preferably not more than 100 mol %, or not more than 95 mol %.

The monomer unit derived from the alcohol component may also include a monomer unit derived from an aromatic diol.

The content of the monomer units derived from the aromatic diol as a percentage of the monomer units derived from the alcohol component is preferably at least 0 mol %, or at least 5 mol %, or at least 10 mol %, or at least 15 mol %, or at least 20 mol %, or at least 30 mol %. The percentage content is also preferably not more than 60 mol %, or not more than 50 mol %, or not more than 40 mol %.

These numerical ranges for percentage content may be combined at will.

Dissolution of the polyester resin in the carrier liquid can be suppressed if the content of the monomer units derived from an aromatic diol and the content of the monomer units derived from the $C_{2-12}$ aliphatic diol as a percentage of the monomer units derived from an alcohol component are within the above ranges.

The monomer unit derived from the $C_{2-12}$ aliphatic diol is preferably a monomer unit derived from a $C_{2-6}$ aliphatic diol from the standpoint of availability.

Examples of the monomer unit derived from the $C_{2-12}$ (preferably $C_{2-6}$) aliphatic diol includes the following: ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexane dimethanol and dipropylene glycol.

The monomer unit derived from the acid component preferably includes a monomer unit derived from a $C_{8-12}$ aromatic dicarboxylic acid.

The content of the monomer units derived from the $C_{8-12}$ aromatic dicarboxylic acid as a percentage of the monomer units derived from the acid component is from preferably 75 mol % to 100 mol %, or more preferably in the range from 85 mol % to 100 mol %, or still more preferably in the range from 90 mol % to 100 mol %, or yet more preferably in the range from 95 mol % to 100 mol %.

If the content of the monomer units derived from the $C_{8-12}$ aromatic dicarboxylic acid as a percentage of the monomer units derived from the acid component is within the above range, the polyester resin skeleton is less flexible, and the solubility of the polyester resin in the carrier liquid can be reduced.

The monomer unit derived from the $C_{8-12}$ aromatic dicarboxylic acid is preferably a monomer unit derived from a $C_{8-10}$ aromatic dicarboxylic acid from the standpoint of availability.

Examples of the monomer unit derived from the $C_{8-12}$ (preferably $C_{8-10}$) aromatic dicarboxylic acid include aromatic dicarboxylic acids such as phthalic acid, isophthalic acid and terephthalic acid, and their anhydrides; and polycarboxylic acids such as trimellitic acid and pyromellitic acid, and their anhydrides.

The toner particle may also contain a colorant.

The colorant is not particularly limited, and may be a known organic pigment, inorganic pigment or the like.

Specific examples of yellow pigments include the following: C.I. pigment yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185, and C.I. vat yellow 1, 3 and 20.

Examples of red or magenta pigments include the following: C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238 and 269, C.I. pigment violet 19, and C.I. vat red 1, 2, 10, 13, 15, 23, 29 and 35.

Examples of blue or cyan pigments include the following: C.I. pigment blue 2, 3, 15:2, 15:3, 15:4, 16 and 17, C.I. vat blue 6, C.I. acid blue 45, and copper phthalocyanine pigments comprising from 1 to 5 phthalimidomethyl groups substituted on a phthalocyanine skeleton.

Examples of green pigments include C.I. pigment green 7, 8 and 36.

Examples or orange pigments include C.I. pigment orange 66 and 51.

Examples of black pigments include carbon black, titanium black and aniline black.

Examples of white pigments include basic lead carbonate, zinc oxide, titanium oxide and strontium titanate.

A dispersion means suited to the toner particle manufacturing method may be used to disperse the pigment in the toner particle. Examples of devices that can be used as dispersion means include ball mills, sand mills, attritors, roll mills, jet mills, homogenizers, paint shakers, kneaders, agitators, Henschel mixers, colloid mills, ultrasound homogenizers, pearl mills, wet jet mills and the like.

The content of the colorant is preferably in the range from 1 to 100 mass parts, or more preferably in the range from 5 to 50 mass parts per 100 mass parts of the resin component in the toner particle.

A pigment dispersing agent may be added when dispersing the pigment.

Examples of pigment dispersing agents include carboxylic acid esters containing hydroxyl groups, salts of long-chain polyaminoamides with high-molecular-weight acid esters, salts of high-molecular-weight polycarboxylic acids, high-molecular-weight unsaturated acid esters, high-molecular-weight copolymers, modified polyacrylates, aliphatic polycarboxylic acids, naphthalene sulfonic acid formaline condensates, polyoxyalkylene alkyl phosphate esters, pigment derivatives and the like. A commercial polymeric dispersing agent such as the Solsperse series (Lubrizol Japan Limited) is also desirable.

Depending on the kind of pigment, a synergist may also be used as a pigment dispersion aid.

The added amount of these pigment dispersing agents and pigment dispersion aids is preferably in the range from 1 to 50 mass parts per 100 mass parts of the pigment.

The liquid developer contains a toner particle dispersing agent. This toner particle dispersing agent is a polymer having a primary amino group. The primary amino group here is a group represented by $—NH_2$.

The volume resistivity of the liquid developer is affected by the concentration of free toner particle dispersing agent in the carrier liquid.

The toner particle dispersing agent has substituents that increase solubility in the carrier liquid in order to produce sufficient repulsion in the carrier liquid and thereby increase the dispersion stability of the toner particle.

On the other hand, toner particle dispersing agent that does not bind with the polyester resin in the toner particle exists freely in the carrier liquid without being adsorbed by the toner particle, and thus reduces the volume resistivity of the liquid developer.

However, by making the toner particle dispersing agent be a polymer having a primary amino group, it is possible to suppress the release of the toner particle dispersing agent into the carrier liquid, and prevent a drop in the volume resistivity of the liquid developer.

A known toner particle dispersing agent that is not a polymer having a primary amino group may also be included to the extent that this does not detract from the effects of the invention.

An amine value of the polymer having the primary amino group is at least 30 mg KOH/g.

As discussed above, the volume resistivity of the liquid developer is reduced if a high concentration of free toner particle dispersing agent or a high concentration of binding products of the toner particle dispersing agent and the polyester resin is released into the carrier liquid.

If the amine value of the polymer having the primary amino group is at least 30 mg KOH/g, the concentration of free toner particle dispersing agent or the concentration of binding products of the toner particle dispersing agent and polyester resin in the carrier liquid can be prevented from rising.

This is because if the amine value of the polymer having the primary amino group (toner particle dispersing agent) is at least 30 mg KOH/g, the number of amino groups per molecule of the toner particle dispersing agent is relatively large. It is thought that as a result, the amino groups of the toner particle dispersing agent bind thoroughly with the acid groups that are the binding sites of the polyester resin in the toner particle, thereby preventing the concentration of free toner particle dispersing agent in the carrier liquid from rising.

As discussed above, moreover, the higher the ratio of the polyester resin in the binding products of the toner particle dispersing agent and polyester resin, the more the solubility behavior of the binding products of the toner particle dispersing agent and polyester resin in the carrier liquid resembles the solubility behavior of the polyester resin in the carrier liquid. Thus, it is thought by giving the polymer having the primary amino group an amine value of at least 30 mg KOH/g, it is possible to suppress elution of binding products of the toner particle dispersing agent and polyester resin into the carrier liquid.

The amine value of the polymer having the primary amino group is preferably in the range from 30 mg KOH/g to 200 mg KOH/g, or more preferably in the range from 60 mg KOH/g to 100 mg KOH/g.

If the amine value of the polymer having the primary amino group is within this range, thorough binding between the toner particle dispersing agent and polyester resin can be achieved. This is also desirable from the standpoint of productivity.

The polymer having the primary amino group is preferably a polymer containing a monomer unit represented by formula (1) below and a monomer unit represented by formula (2) below:

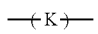

(1)

In formula (1), K represents a monomer unit having a primary amino group.

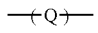

(2)

In formula (2), Q represents a monomer unit having an optionally substituted alkyl group having at least 6 carbon atoms, an optionally substituted cycloalkyl group having at least 6 carbon atoms, an optionally substituted alkylene group having at least 6 carbon atoms, or an optionally substituted cycloalkylene group having at least 6 carbon atoms.

The optionally substituted alkyl group having at least 6 carbon atoms or optionally substituted cycloalkyl group having at least 6 carbon atoms of Q in formula (2) is an alkyl group or cycloalkyl group in which the carbon number n is at least 6, represented as the linear —$C_nH_{2n+1}$ or the cyclic —$C_nH_{2n-1}$. The optionally substituted alkylene group having at least 6 carbon atoms or optionally substituted cycloalkylene group having at least 6 carbon atoms is an alkylene group or cycloalkylene group in which the carbon number n is at least 6, represented as the liner —$C_nH_{2n}$— or the cyclic —$C_nH_{2n-2}$—.

From the standpoint of affinity for the carrier liquid, the carbon number n is more preferably at least 12. The upper limit of the carbon number n is preferably not more than 30, or more preferably not more than 22. At least one hydrogen atom of the alkyl group, cycloalkyl group, alkylene group or cycloalkylene group may also be substituted.

The optional substituent of the alkyl group, cycloalkyl group, alkylene group or cycloalkylene group of Q is not particularly limited, and may be an alkyl or alkoxy group, a halogen atom, or an amino, hydroxy, carboxy, carboxylic acid ester or carboxylic acid amide group or the like.

The monomer unit represented by the formula (1) is more preferably a monomer unit represented by formula (3) below:

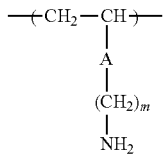

(3)

In formula (3), A represents a $C_{1-6}$ (preferably $C_{1-3}$) alkylene group or a phenylene group, and m is an integer from 0 to 3.

The monomer unit represented by the formula (1) is still more preferably a monomer unit represented by formula (4) below:

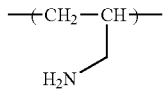

(4)

Furthermore, the monomer unit represented by the formula (2) is more preferably a monomer unit represented by formula (5) below:

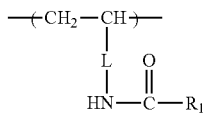

(5)

In formula (5), $R_1$ represents an optionally substituted alkyl group having at least 6 carbon atoms or an optionally substituted cycloalkyl group having at least 6 carbon atoms, and L represents a divalent linking group.

$R_1$ is represented by the linear —$C_nH_{2n+1}$ or the cyclic —$C_6H_{2n+1}$, and $R_1$ is an alkyl group or cycloalkyl group in which n is at least 6.

More preferably, n is at least 12. The upper limit of n is preferably not more than 30, or more preferably not more than 22.

The optional substituent of $R_1$ is also not particularly limited, and may be an alkyl or alkoxy group, a halogen atom, or an amino, hydroxy, carboxy, carboxylic acid ester or carboxylic acid amide group or the like.

L represents a divalent linking group, and is preferably a $C_{1-6}$ alkylene group (more preferably a $C_{1-3}$ alkylene group), a $C_{1-6}$ alkenylene group (more preferably a $C_{1-3}$ alkenylene group) or $C_{6-10}$ arylene group.

In another more preferred embodiment, the monomer unit represented by the formula (2) is a monomer unit represented by the following formula (6):

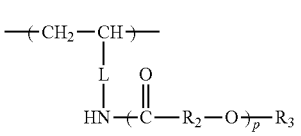

(6)

In the formula (6), $R_2$ is an optionally substituted alkylene group having at least 6 carbon atoms or optionally substituted cycloalkylene group having at least 6 carbon atoms, $R_3$ is hydrogen or —C(=O)—$R_4$, in which $R_4$ is an optionally substituted alkyl group having at least 6 carbon atoms or optionally substituted cycloalkyl group having at least 6 carbon atoms. p represents 1 or an integer of 1 or greater (preferably from 2 to 20), and L is a divalent linking group.

$R_2$ is represented by the linear —$C_nH_{2n}$— or the cyclic —$C_nH_{2n-2}$—, and $R_2$ is an alkylene group or cycloalkylene group with a carbon number of at least 6. The carbon number of this alkylene or cyclalkylene group is more preferably at least 12. The upper limit of the carbon number is preferably not more than 30, or still more preferably not more than 22.

The optional substituent of $R_2$ is also not particularly limited, and may be an alkyl or alkoxy group, a halogen atom, or an amino, hydroxy, carboxy, carboxylic acid ester or carboxylic acid amide group or the like.

$R_4$ is represented by the linear —$C_nH_{2n+1}$ or the cyclic —$C_nH_{2n-1}$, and $R_4$ is an alkyl group or cycloalkyl group in which n is at least 6. More preferably, n is at least 12. The upper limit of n is preferably not more than 30, or still more preferably not more than 22.

The optional substituent of $R_3$ is not particularly limited, and may be an alkyl or alkoxy group, a halogen atom, or an amino, hydroxy, carboxy, carboxylic acid ester or carboxylic acid amide group or the like.

Preferred examples of L are the same as in formula (5).

Any monomer unit represented by formula (1) above may be combined at will with any monomer unit represented by formula (2) above.

The polymer having the primary amino group is preferably a polyallylamine derivative containing the monomer unit represented by formula (4) above in the polymer.

The number of monomer units represented by formula (4) above that are contained in one molecule of this polyallylamine derivative is preferably an average of from 10 to 200, or more preferably from 20 to 150, or still more preferably from 50 to 150.

Furthermore, the polymer having the primary amino group is more preferably a polyallylamine derivative containing the monomer unit represented by formula (4) above and the monomer unit represented by formula (6) above in one polymer.

The molar ratio of the monomer units represented by the formula (4) above and the monomer units represented by the formula (6) above [monomer units represented by formula (4):monomer units represented by formula (6)] in the polymer is preferably 10:90 to 90:10, or more preferably 50:50 to 80:20.

More preferably, this is a reaction product of polyallylamine and a self-condensate of 12-hydroxystearic acid.

This polyallylamine derivative can be manufactured by known methods, such as the methods disclosed in Japanese Patent No. 3718915.

A commercial polyamine compound and polyamine compound solution may be used to manufacture this polyallylamine derivative. Examples include PAA-01, PAA-03, PAA-05, PAA-08, PAA-15, PAA-15C, PAA-25 and PAA-03E (manufactured by Nittobo Medical Co., Ltd.).

The ratio of the total number of acid groups in the polyester resin with an acid value of at least 5 mg KOH/g to the total number of amino groups in the polymer having the primary amino group in the liquid developer is at least 1.0.

If the ratio of the total number of acid groups in the polyester resin with an acid value of at least 5 mg KOH/g to the total number of amino groups in the polymer having the primary amino group in the liquid developer is less than 1.0, the toner particle dispersing agent (polymer having the primary amino group) that has not bound to the polyester resin is eluted into the carrier liquid, causing a drop in the volume resistivity of the liquid developer.

The lower limit of the ratio of the total number of acid groups in the polyester resin with an acid value of at least 5 mg KOH/g to the total number of amino groups in the polymer having the primary amino group in the liquid developer is more preferably at least 1.5.

There is no particular upper limit on the ratio of the total number of acid groups in the polyester resin with an acid value of at least 5 mg KOH/g to the total number of amino groups in the polymer having the primary amino group in the liquid developer, but preferably it is not more than 10.0, or more preferably not more than 5.0, or still more preferably not more than 3.0.

A total number of amino groups in the polymer having the primary amino group and a total number of acid groups in the polyester resin are calculated as follows:

Total number of amino groups in polymer having primary amino group=amine value of polymer having primary amino group [mg KOH/g]×mass [g] of polymer having primary amino group per 100 g of liquid developer;

Total number of acid groups in polyester resin=acid value [mg KOH/g] of polyester resin×mass [g] of polyester resin per 100 g of liquid developer.

The number-average molecular weight (Mn) of the polymer having the primary amino group is preferably in the range from 5,000 to 300,000, or more preferably in the range from 10,000 to 200,000.

The content of the polymer having the primary amino group is preferably in the range from 0.5 to less than 100 mass parts, or more preferably in the range from 1.0 to 30.0 mass parts, or still more preferably in the range from 1.0 to 10.0 mass parts per 100 mass parts of the polyester resin.

When a polymerizable liquid compound is used as the carrier liquid, a reaction called an initiation reaction is necessary to initiate the polymerization reaction of the polymerizable liquid compound. The substance used for this is called a polymerization initiator.

When the polymerizable liquid compound is a component that is polymerizable by a photopolymerization reaction, a photopolymerization initiator that generates acid and radicals in response to light of a specific wavelength may be used.

To suppress a decrease in the volume resistivity of the polymerizable liquid compound, the polymerization initiator represented by formula (7) below may be used for example:

(7)

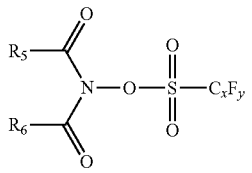

In formula (7), $R_5$ and $R_6$ bind together to form a ring structure, x represents an integer from 1 to 8, and y represents an integer from 3 to 17.

This photopolymerization initiator is decomposed by ultraviolet irradiation to generate the strong acid sulfonic acid. A sensitizer may also be included, and absorption of UV rays by the sensitizer may be used as a trigger to decompose the polymerization initiator and generate sulfonic acid.

The ring structure formed by binding of $R_5$ and $R_6$ may be a 5-member ring or 6-member ring for example. Specific examples of ring structures formed by binding of $R_5$ and $R_6$ include succinimide, phthalimide, nobornene dicarboximide, naphthalene decarboximide, cyclohexane dicarboximide and epoxycyclohexene decarboximide structures and the like.

The ring structure may also have an alkyl group, alkyloxy group, alkylthio group, aryl group, aryloxy group, arylthio group or the like as a substituent.

The highly electron-attractive $C_xF_y$ group is a fluorocarbon group, which is a functional group for decomposing the sulfonic acid ester part by UV irradiation. The number of carbon atoms that it has is preferably in the range from 1 to 8 (x=in the range from 1 to 8), and the number of fluorine atoms is preferably in the range from 3 to 17 (y=in the range from 3 to 17).

Examples of $C_xF_y$ in formula (7) include linear alkyl groups with fluorine atoms substituted for hydrogen atoms (RF1), branched alkyl groups with fluorine atoms substituted for hydrogen atoms (RF2), cycloalkyl groups with fluorine atoms substituted for hydrogen atoms (RF3), and aryl groups with fluorine atoms substituted for hydrogen atoms (RF4).

Examples of linear alkyl groups with fluorine atoms substituted for hydrogen atoms (RF1) include trifluoromethyl (x=1, y=3), pentafluoroethyl (x=2, y=5), heptafluoro-n-propyl (x=3, y=7), nonafluoro-n-butyl (x=4, y=9), perfluoro-n-hexyl (x=6, y=13) and perfluoro-n-octyl (x=8, y=17) groups and the like.

Examples of branched alkyl groups with fluorine atoms substituted for hydrogen atoms (RF2) include perfluoroisopropyl (x=3, y=7), perfluoro-tert-butyl (x=4, y=9) and perfluoro-2-ethylhexyl (x=8, y=17) groups and the like.

Examples of cycloalkyl groups with fluorine atoms substituted for hydrogen atoms (RF3) include perfluorocyclobutyl (x=4, y=7), perfluorocyclopentyl (x=5, y=9), perfluorocyclohexyl (x=6, y=11) and perfluoro(1-cyclohexyl) methyl (x=7, y=13) groups and the like.

Examples of aryl groups with fluorine atoms substituted for hydrogen atoms (RF4) include pentafluorophenyl (x=6, y=5) and 3-trifluoromethyl tetrafluorophenyl (x=7, y=7) groups and the like.

From the standpoint of availability and decomposition of the sulfonic acid ester part, linear alkyl groups (RF1), branched alkyl groups (RF2) and aryl groups (RF4) are preferred for the $C_xF_y$ group in formula (7) above. A linear alkyl group (RF1) or aryl group (RF4) is more preferred. Most preferred are a trifluoromethyl group (x=1, y=3), pentafluoroethyl group (x=2, y=5), heptafluoro-n-propyl group (x=3, y=7), nonafluoro-n-butyl group (x=4, y=9) or pentafluorophenyl group (x=6, y=5).

One photopolymerization initiator alone or a combination of two or more kinds may be used.

The content of the photopolymerization initiator is not particularly limited, but is preferably in the range from 0.01 to 5 mass parts, or more preferably in the range from 0.05 to 1 mass part, or still more preferably in the range from 0.1 to 0.5 mass parts per 100 mass parts of the polymerizable liquid compound.

Specific examples of the photopolymerization initiator represented by the formula (7) are given below [example compounds B-1 to B-27], but the present invention is not limited to these examples.

(B-1)

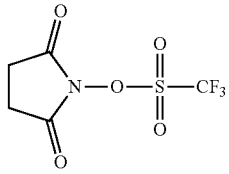

(B-2)

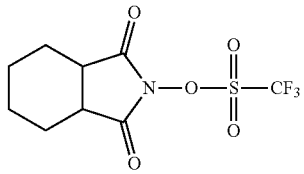

(B-3)

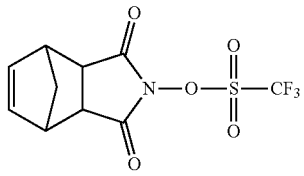

(B-4)

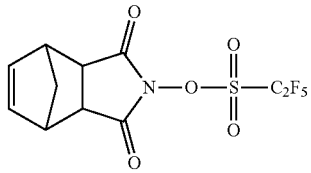

(B-5)

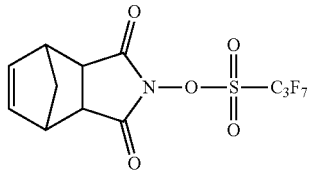

-continued
(B-6)
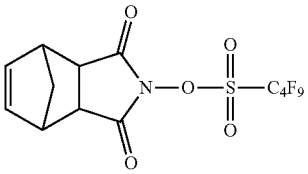
(B-7)
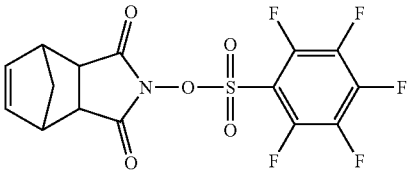
(B-8)
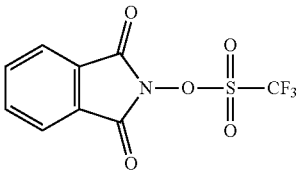
(B-9)
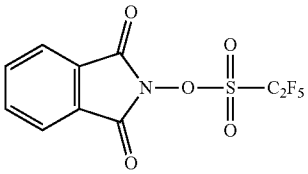
(B-10)
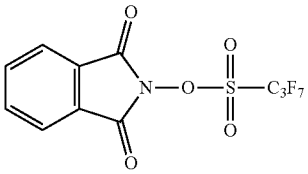
(B-11)
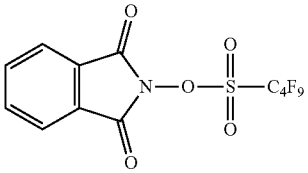
(B-12)
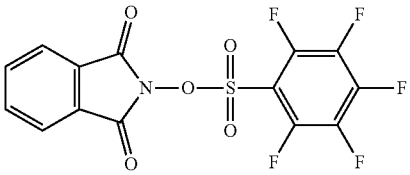
(B-13)
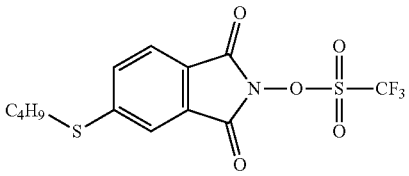
-continued
(B-14)
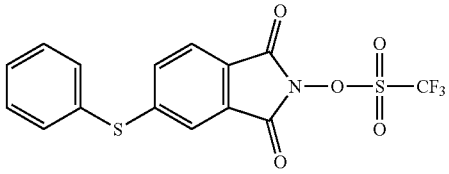
(B-15)
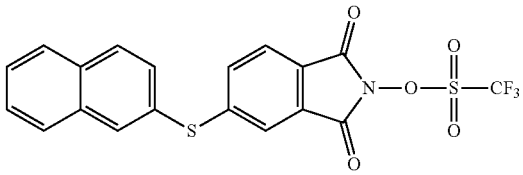
(B-16)
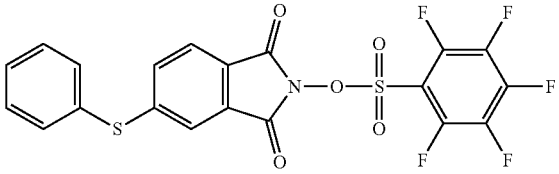
(B-17)
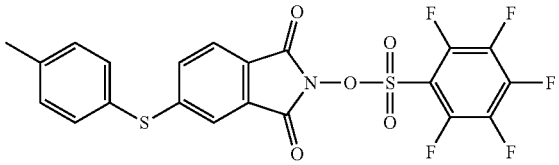
(B-18)
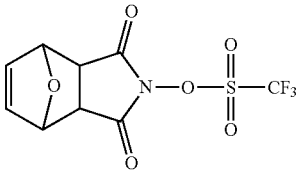
(B-19)
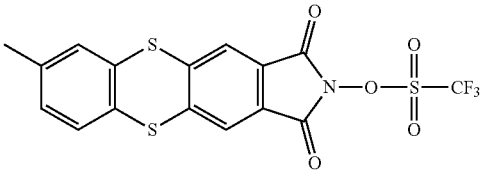
(B-20)
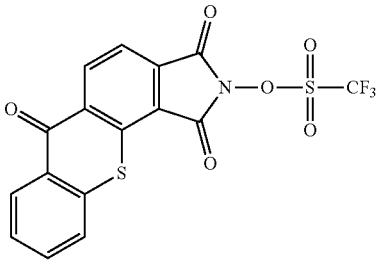
(B-21)
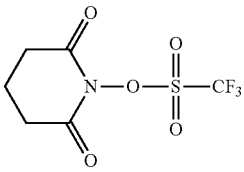

-continued (B-22)

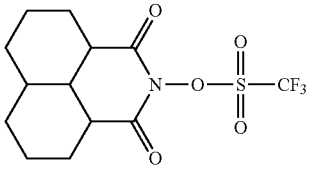

(B-23)

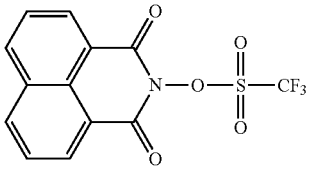

(B-24)

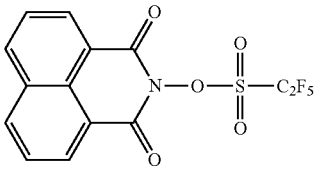

(B-25)

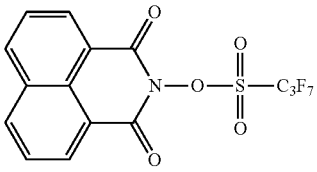

(B-26)

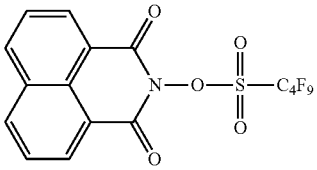

(B-27)

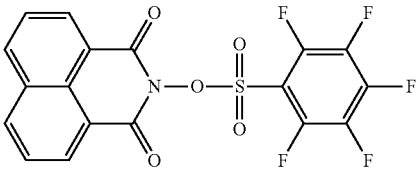

<Sensitizer and Sensitizing Aid>

The liquid developer may also contain a sensitizer as necessary to improve the acid generating efficiency of the photopolymerization initiator and lengthen the photosensitive wavelength.

The sensitizer is not particularly limited as long as it can increase the sensitivity of the electron transfer mechanism and energy transfer mechanism to the photopolymerization initiator.

Specific examples include aromatic polycondensed ring compounds such as anthracene, 9,10-dialkoxyanthracene, pyrene and perylene, aromatic ketone compounds such as acetophenone, benzophenone, thioxanthone and Michler's ketone, and heterocyclic compounds such as phenothiazine and N-aryloxazolidinone.

The content of the sensitizer may be selected appropriately according to the object, but is generally in the range from 0.1 to 10 mass parts, or preferably in the range from 1 to 5 mass parts per 1 mass part of the photopolymerization initiator.

The liquid developer may also contain a sensitizing aid with the aim of further improving the electron transfer efficiency or energy transfer efficiency between the sensitizer and the photopolymerization initiator.

Specific examples include naphthalene compounds such as 1,4-dihydroxynaphthalene, 1,4-dimethoxynaphthalene, 1,4-diethoxynaphthalene, 4-methoxy-1-naphthol and 4-ethoxy-1-napthol, and benzene compounds such as 1,4-dihydroxybenzene, 1,4-dimethoxybenzene, 1,4-diethoxybenzene, 1-methoxy-4-phenol and 1-ethoxy-4-phenol.

The content of the sensitizing aid may be selected appropriately according to the object, but is preferably in the range from 0.1 to 10 mass parts, or more preferably in the range from 0.5 to 5 mass parts per 1 mass part of the sensitizer.

The liquid developer may also contain a charge control agent as necessary. A known charge control agent may be used.

Specific compounds include the following: oils such as linseed oil and soybean oil; alkyd resins, halogen polymers, aromatic polycarboxylic acids, water-soluble dyes containing acidic groups, oxidative condensates of aromatic polyamines, and metal soaps such as cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate and cobalt 2-ethylhexanoate; sulfonic acid metal salts such as petroleum-based sulfonic acid metal salts and metal salts of sulfosuccinic acid esters; phospholipids such as hydrogenated lecithin and lecithin; salicylic acid metal salts such as t-butylsalicylic acid metal complexes; and polyvinylpyrrolidone resin, polyamide resin, sulfonic acid-containing resins, hydroxybenzoic acid derivatives and the like.

The toner particle may also contain a charge auxiliary for purposes of adjusting the charging performance of the toner particle. A known charge auxiliary may be used.

Examples of specific compounds include metal soaps such as zirconium naphthenate, cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, aluminum tristearate and cobalt 2-ethylhexanoate; sulfonic acid metal salts such as petroleum-based sulfonic acid metal salts and metal salts of sulfosuccinic acid esters; phospholipids such as hydrogenated lecithin and lecithin; salicylic acid metal salts such as t-butylsalicylic acid metal complexes; and polyvinylpyrrolidone resin, polyamide resin, sulfonic acid-containing resins, hydroxybenzoic acid derivatives and the like.

In addition to those explained above, various known additives may also be used in the liquid developer as necessary to improve the recording medium compatibility, storage stability, image storability and other properties.

Surfactants, lubricants, filler, defoamers, UV absorbers, antioxidants, anti-fading agents, mildewproof agents, rust inhibitors and the like for example can be selected appropriately and used as these various other additives.

The method for manufacturing the liquid developer is not particularly limited, and for example a known method such as the coacervation method described below or a wet pulverization method or mini-emulsion polymerization method may be used.

As a common manufacturing method, for example the resin and other additives are mixed together with a dispersion medium, and pulverized with a bead mill or the like to obtain a toner particle dispersion. The resulting toner particle dispersion is mixed with a carrier liquid and the like to obtain a curable liquid developer.

Coacervation methods are described for example in Japanese Patent Application Publication 2003-241439, WO 2007/000974 or WO 2007-000975.

In coacervation methods, the resin, a solvent that dissolves the resin, a toner particle dispersing agent and a solvent that does not dissolve the resin (such as a carrier liquid) can be mixed, and the solvent that dissolves the resin can be removed from the mixture to precipitate the resin that was in a dissolved state and thereby disperse the toner particle in the solvent that does not dissolve the resin.

On the other hand, wet pulverization methods are described for example in WO 2006/126566 or WO 2007-108485.

In wet pulverization methods, on the other hand, the resin and other additives can be kneaded at a temperature at or above the melting point of the resin and dry pulverized, and the resulting pulverized product and a toner particle dispersing agent can be wet pulverized in a carrier liquid to disperse the toner particle in the carrier liquid.

With coacervation methods, it is easy to control the particle size and dispersion stability of the toner particle.

The liquid developer manufacturing method of the present invention is a method for manufacturing a liquid developer containing a carrier liquid, a toner particle that is insoluble in the carrier liquid, and a toner particle dispersing agent, the method comprises a step (i) of preparing a resin-dispersed solution containing a polyester resin with an acid value in a range from 5 mg KOH/g to 50 mg KOH/g, a polymer having a primary amino group and an amine value of from 30 mg KOH/g to 200 mg KOH/g, and a solvent that dissolves the polyester resin, a step (ii) of preparing a mixture containing the resin-dispersed solution and a carrier liquid with an SP value of not more than 8.20, and a step (iii) of distilling off the solvent from the mixture.

There are no particular limitations on what solvent can be used in the step (i) above as long as it is a solvent that dissolves the polyester resin.

A measure of whether the solvent dissolves the polyester resin is whether at least 333 mass parts of the polyester resin dissolve in 100 mass parts of the solvent at 25° C.

Examples include ethers such as tetrahydrofuran, ketones such as methyl ethyl ketone and cyclohexanone, esters such as ethyl acetate, and halide compounds such as chloroform. An aromatic hydrocarbon such as toluene or benzene is also possible as long as it can dissolve the polyester resin.

In the step (ii) above a mixture of the resin-dispersed solution and carrier liquid is prepared, but a solvent that is not a carrier liquid and does not dissolve the polyester resin may be used instead of the carrier liquid.

A measure of whether a solvent does not dissolve the polyester resin is whether not more than 1 mass part of the polyester resin dissolves in 100 mass parts of the solvent at 25° C.

When a toner particle has been produced using such a solvent that does not dissolve the polyester resin, a liquid developer can be manufactured by a method of adding the carrier liquid or a method of substituting the carrier liquid for the solvent once the toner particle has been produced.

That is, this is a liquid developer manufacturing method for manufacturing a liquid developer containing a carrier liquid, a toner particle that is insoluble in the carrier liquid, and a toner particle dispersing agent, comprising a step (I) of preparing a resin-dispersed solution containing a polyester resin with an acid value of from 5 mg KOH/g to 50 mg KOH/g, a polymer having a primary amino group and an amine value of from 30 mg KOH/g to 200 mg KOH/g, and a solvent that dissolves the polyester resin, a step (II) of preparing a first mixture containing the resin-dispersed solution and a solvent other than a carrier liquid with an SP value of not more than 8.20 that does not dissolve the polyester resin, a step (III) of removing the solvent that dissolves the polyester resin from the first mixture to prepare a toner particle dispersion, and a step (IV) of preparing a second mixture containing the toner particle dispersion and the carrier liquid.

Additives such as a photopolymerization initiator and a charge control agent may also be added as necessary after the step (iii) or step (IV) above to obtain a liquid developer.

Moreover, the volume resistivity of the liquid developer is preferably in the range from $5\times10^{8}$ Ω·cm to $1\times10^{15}$ Ω·cm, or more preferably in the range from $1\times10^{9}$ Ω·cm to $1\times10^{13}$ Ω·cm.

The liquid developer may be used favorably in common electrophotographic image-forming devices.

The measuring methods used in the present invention are given below.

<Methods for Analysing Composition of Resin, Etc.>

The following methods were used for structural determination of compounds. $^{1}$H-NMR and $^{13}$C-NMR spectrum measurement was performed using an ECA-400 (400 MHz) manufactured by JEOL Ltd. Measurement was performed at 25° C. in a deuterated solvent containing tetramethylsilane as an internal standard substance. The chemical shift value is shown as a ppm shift value (δ value) given 0 as the tetramethyl silane used as an internal standard substance.

<Method for Measuring Molecular Weight of Resin, Etc.>

The weight-average molecular weight (Mw) and number-average molecular weight (Mn) of the resin and the like were calculated by polystyrene conversion using gel permeation chromatography (GPC). The GPC molecular weight measurement methods are given below.

The sample was added to the following eluent to a sample concentration of 1.0 mass %, and dissolved by standing for 24 hours at room temperature, and the resulting solution was filtered with a solvent-resistant membrane filter with a pore diameter of 0.20 microns to obtain a sample solution that was then measured under the following conditions.

Equipment: HLC-8220 GPC high-speed GPC unit [manufactured by Tosoh Corp.]

Columns: 2 series of LF-804

Eluent: Tetrahydrofuran (THF)

Flow rate: 1.0 mL/min

Oven temperature: 40° C.

Sample injection volume: 0.025 mL

A molecular weight calibration curve prepared using standard polystyrene resin [product name: TSK standard polystyrene F-850, F-450, F-288, F-128, F-80, F-40, F-20, F-10, F-4, F-2, F-1, A-5000, A-2500, A-1000, A-500, manufactured by Tosoh Corporation] is used for calculating the molecular weights of the samples.

<Method for Measuring Acid Value>

The basic operations for measuring acid value are based on JIS K 0070.

Specifically, this is determined by the following methods.

1) 0.5 to 2.0 g of the sample is weighed exactly, and the mass is given as M1 (g).

2) The sample is placed in a 50 mL beaker, and 25 mL of a mixed tetrahydrofuran/ethanol (2/1) solution is added to dissolve the sample.

3) Titration is performed with an 0.1 mol/L ethanol solution of KOH, using a potentiometric titrator [COM-2500 automatic titrator, manufactured by Hiranuma Sangyo Co., Ltd.].

4) The amount of the KOH solution used here is given as S1 (mL). A blank is measured at the same time, and the amount of KOH used is given as B1 (mL).

5) The acid value is calculated according to the following formula, with f being the factor of the KOH solution.

$$\text{Acid value [mg KOH/g]}=(S1-B1)\times f\times 5.61/M1$$

<Method for Measuring Amine Value>

The basic operations for measuring the amine value are based on ASTM D2074.

Specifically, this is determined by the following methods.

1) 0.5 to 2.0 g of the sample is weighed exactly, and the mass is given as M2 (g).

2) The sample is placed in a 50 mL beaker, and 25 mL of a mixed tetrahydrofuran/ethanol (3/1) solution is added to dissolve the sample.

3) Titration is performed with a 0.1 mol/L ethanol solution of HCl, using a potentiometric titrator [COM-2500 automatic titrator, manufactured by Hiranuma Sangyo Co., Ltd.].

4) The amount of the HCl solution used here is given as S2 (mL). A blank is measured at the same time, and the amount of HCl used is given as B2 (mL).

5) The amine value is calculated according to the following formula, with f being the factor of the HCl solution.

$$\text{Amine value [mg KOH/g]}=(S2-B2)\times f\times 5.61/M2$$

<Methods for Measuring Acid Value of Polyester Resin Contained in Toner Particle and Amine Value of Polymer Having Primary Amino Group from Liquid Developer>

The methods for measuring the acid value of the polyester resin contained in the toner particle in the liquid developer and the methods for measuring the amine value of the polymer having the primary amino group in the liquid developer are given below.

1) About 10 g of the liquid developer is centrifuged to precipitate the toner particle, and the supernatant is discarded.

2) Hexane is added to the toner particle and thoroughly stirred, the mixture is centrifuged to precipitate the toner particle, and the supernatant is discarded. This operation is repeated three times, and the particle is thoroughly dried.

3) 10 g of tetrahydrofuran is added to 2), and left overnight. This is thoroughly stirred, and the centrifuged to remove the tetrahydrofuran-insoluble component. The tetrahydrofuran-soluble component of the supernatant (mixture of resin and polymer having primary amino group) is thoroughly dried.

4) The acid value and amine value are measured by the above methods using the tetrahydrofuran-soluble component obtained in 3).

<Method for Measuring Volume Resistivity>

Volume resistivity is measured using an R8340A digital ultra-high resistance/micro ammeter (ADC Corporation), by placing 25 mL of the sample on an SME-8330 liquid sample electrode (manufactured by Hioki E.E. Corporation), and applying 1,000 V of direct current at room temperature 25° C.

Examples

The present invention is explained in detail below using examples, but the present invention is not limited by these examples. Unless otherwise specified, "parts" are "mass parts".

[Polyester Resin Manufacturing Examples]

<Manufacturing Example of Polyester Resin (PES-1)>

The following materials were added to reaction kettle equipped with a stirrer, a thermometer and a reflux cooler, and an ester exchange reaction was performed for 2 hours at 220° C.:

100 parts of terephthalic acid, 125 parts of isophthalic acid, 32 parts of trimellitic anhydride, 285 parts of bisphenol A ethylene oxide 2-mol adduct, 60 parts of ethylene glycol, 20 parts of neopentyl glycol, 0.1 parts of n-tetrabutyl titanate as a catalyst, 2 parts of Irganox 1330 (BASF) as an anti-oxidant, and 0.3 parts of sodium acetate as a polymerization stabilizer.

The temperature of the reaction system was then raised from 220° C. to 270° C. as the internal pressure was reduced, after which a polycondensation reaction was performed for 5 hours at 1 Torr or less.

After completion of the reaction, nitrogen was used to return the system from vacuum to normal pressure and obtain a polyester resin (PES-1).

<Manufacturing Examples of Polyester Resins (PES-2) to (PES-6)%

Polyester resins (PES-2) to (PES-6) were obtained as in the manufacturing example of the polyester resin (PES-1) except that the types and added amounts of the monomers were changed to the materials shown in Table 1-1, and the reactions times were adjusted so as to obtain the number-average molecular weights (Mn) shown in Table 1-2.

The physical properties of the resulting polyester resins are shown in Table 1-2.

TABLE 1-1

| | BPA-EO | EG | NPG | TPA | IPA | TMA |
|---|---|---|---|---|---|---|
| PES-1 | 285 | 60 | 20 | 100 | 125 | 32 |
| PES-2 | 285 | 60 | 20 | 100 | 125 | 32 |
| PES-3 | 285 | 60 | 20 | 100 | 125 | 32 |
| PES-4 | — | 120 | 80 | 225 | — | 32 |
| PES-5 | 480 | — | — | 225 | — | 32 |
| PES-6 | 285 | 100 | 20 | 100 | 125 | 32 |

The values for each monomer of each polyester resin in Table 1-1 represent numbers of parts.

TABLE 1-2

| | BPA-EO | EG | NPG | TPA | IPA | TMA | Mn | Acid value (mgKOH/g) |
|---|---|---|---|---|---|---|---|---|
| PES-1 | 6 | 3 | 1 | 4 | 5 | 1 | 3,800 | 21 |
| PES-2 | 6 | 3 | 1 | 4 | 5 | 1 | 4,500 | 17 |
| PES-3 | 6 | 3 | 1 | 4 | 5 | 1 | 10,000 | 6 |
| PES-4 | — | 6 | 4 | 9 | — | 1 | 4,500 | 20 |
| PES-5 | 10 | — | — | 9 | — | 1 | 2,600 | 24 |
| PES-6 | 6 | 3 | 1 | 4 | 5 | 1 | 3,800 | 1 |

The abbreviations in Tables 1-1 and 1-2 are defined as followed.

BPA-EO: Bisphenol A ethylene oxide 2-mol adduct
EG: Ethylene glycol
NPG: Neopentyl glycol
TPA: Terephthalic acid
IPA: Isophthalic acid
TMA: Trimellitic anhydride
Mn: Number-average molecular weight The numerical values for the monomers in each polyester resin in Table 1-2 are the results of NMR measurement of the resulting polyester resin (molar ratios).

<Manufacturing Example of 12-Hydroxystearic Acid Self-Condensate (P-1)>

30.0 parts of xylene (manufactured by Junsei Chemical Co., Ltd.), 300.0 parts of 12-hydroxystearic acid (manufactured by Junsei Chemical Co., Ltd.) and 0.1 parts of tetrabutyl titanate (manufactured by Tokyo Chemical Industry Co., Ltd.) were loaded into a reaction flask equipped with a thermometer, a stirrer, a nitrogen introduction port, a reflux tube and a water separator, and the temperature was raised to 160° C. over the course of 4 hours in a nitrogen flow.

This was then further heated for 4 hours at 160° C. (acid value at this time was about 20 mg KOH/g), and the xylene was distilled off at 160° C.

This was then cooled to room temperature, the water generated in the heating reaction was separated from the xylene in the distillate, and this xylene was returned to the reaction solution. This reaction solution is called the 12-hydroxystearic acid self-condensate (P-1) below.

The polyester contained in the 12-hydroxystearic acid self-condensate (P-1) had an acid value of 22.0 mg KOH/g and a calculated molecular weight (=56,100/acid value) of 2,550.

Incidentally, a polyester resin manufactured in this way is used together with the solvent (xylene) as a manufacturing material for a polyallylamine derivative.

<Manufacturing Example of 12-Hydroxystearic Acid Self-Condensate (P-2)>

90 parts of 12-hydroxystearic acid (product name: 12-Hydro acid HP, manufactured by Kokura Synthetic Industries, Ltd.; purity of 99% or higher) and 10 parts of stearic acid (Kanto Chemical Co., Inc., special grade) were loaded into a reaction flask equipped with a thermometer, a stirrer, a nitrogen introduction port, a reflux tube, a water separator and a decompression port, reacted for 30 minutes at 150° C. in a nitrogen atmosphere, and then heated for 2 hours at 200° C. under reduced pressure. This was then cooled to room temperature to obtain a 12-hydroxystearic acid self-condensate (P-2). The 12-hydroxystearic acid self-condensate (P-2) had an acid value of 34.5 mg KOH/g, and a calculated molecular weight (=56,100/acid value) of 1,626.

[Toner particle dispersing agent manufacturing examples]

<Manufacturing Example of Toner Particle Dispersing Agent (Dis-1)>

25.0 parts of xylene and 70.0 parts of a polyallylamine 10% aqueous solution ("PAA-1LV", manufactured by Nittobo Medical Co., Ltd., number-average molecular weight (Mn) 3,000) were loaded into a reaction flask equipped with a thermometer, a stirrer, a nitrogen introduction port, a reflux tube and a water separator, and heated to 160° C. under stirring. The water was distilled off from the reaction solution with a separation unit and the xylene was returned to the reaction solution as 69.6 parts of the above 12-hydroxystearic acid self-condensate (P-1) were added (amine value was 86.5 mg KOH/g immediately after mixing), and a reaction was performed for 2 hours at 160° C. to obtain a toner particle dispersing agent (Dis-1) [amine value 70 mg KOH/g, reaction rate 19% [(86.5 mg KOH/g-70 mg KOH/g)/86.5 mg KOH/g].

<Manufacturing Examples of Toner Particle Dispersing Agents (Dis-2) to (Dis-4)>

Toner particle dispersing agents (Dis-2) to (Dis-4) were obtained as in the manufacturing example of the toner particle dispersing agent (Dis-1) except that the type of polyallylamine, the added amount of the 12-hydroxystearic acid self-condensate (P-1) and the reaction rate were changed as shown in Table 2. The physical properties of the toner particle dispersing agents are shown in Table 2.

TABLE 2

| | Polyallylamine compound | Added amount of (P-1) (parts) | Amine value (mg KOH/g) | Reaction rate (%) |
|---|---|---|---|---|
| Dis-1 | PAA-1LV | 69.6 | 70 | 19 |
| Dis-2 | PAA-1C | 69.6 | 35 | 60 |
| Dis-3 | PAA-1LV | 13.9 | 39 | 88 |
| Dis-4 | PAA-1LV | 69.6 | 20 | 77 |

In Table 2, PAA-1C is the PAA-1C polyallylamine 10% aqueous solution (manufactured by Nittobo Medical Co., Ltd., number-average molecular weight (Mn) 10,000).

<Manufacturing Example of Toner Particle Dispersing Agent (Dis-5)>

8 parts of xylene and 10 parts of PAA-1LV polyallylamine 10% aqueous solution (manufactured by Nittobo Medical Co., Ltd., number-average molecular weight (Mn): 3,000) were added to a flask with an attached Dean Stark trap, and stirred as the water was distilled off at 160° C.

A mixture of 12 parts of stearic acid and 50 parts of xylene was heated to 160° C. and added to this, and reacted for 2 hours at 160° C. to obtain a toner particle dispersing agent (Dis-5) with an amine value of 70 mg KOH/g.

<Manufacturing Example of Toner Particle Dispersing Agent (Dis-6)>

6.7 parts of PAA-08 (manufactured by Nittobo Medical Co., Ltd., polyallylamine 15% aqueous solution, weight-average molecular weight 8,000) (the amount of polyallylamine: 1 part) and 10 parts of the 12-hydroxystearic acid self-condensate (P-2) were added to a reaction flask equipped with a thermometer, a stirrer, a nitrogen introduction port, a reflux tube, a water separator and a decompression port, and stirred as the water was distilled off at 140° C. After 2 hours of the reaction, this was cooled to room temperature to obtain a toner particle dispersing agent (Dis-6) with an amine value of 62 mg KOH/g.

<Charge Control Agent Manufacturing Example>

17.9 parts of 2-(methacryloyloxy)ethyl 2-(trimethylammonio)ethyl phosphate, 82.1 parts of octadecyl methacrylate, 4.1 parts of azobisisobutyronitrile and 900 parts of n-butanol were loaded into a reactor with an attached cooling tube, stirrer, thermometer and nitrogen introduction tube, and nitrogen bubbling was performed for 30 minutes.

The resulting reaction mixture was heated for 8 hours at 65° C. in a nitrogen atmosphere to complete a polymerization reaction.

The reaction solution was cooled to room temperature, and the solvent was distilled off under reduced pressure.

The resulting residue was dissolved in chloroform, and purified by dialysis with a dialysis membrane (Spectra/Por7 MWCO 1 kDa, Spectrum Laboratories Inc.).

The solvent was distilled off under reduced pressure, and the product was vacuum dried at 50° C., 0.1 kPa or less to obtain a charge control agent (CD-1).

The resulting charge control agent (compound CD-1) was confirmed to have a weight-average molecular weight (Mw) of 11,800, and the following structural formula:

COMPOUND (CD-1)

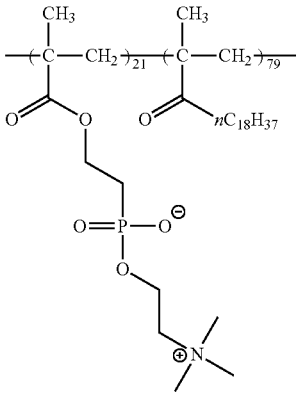

<Preparation of Charge Control Agent Dispersion (CD-1a)>

6.2 parts of the charge control agent (CD-1) and 68.2 parts of tetrahydrofuran were placed in a reactor with an attached stirrer and thermometer, and the temperature was raised to 60° C. to dissolve the charge control agent (CD-1).

61.3 parts of Moresco White MT-30P (Moresco Corporation) were added to this, and the tetrahydrofuran was then distilled off under reduced pressure at 50° C., 4 kPa to obtain a charge control agent dispersion (CD-1a) in the form of a clear reverse micelle liquid.

<Preparation of Charge Control Agent Dispersion (CD-1b)>

A charge control agent dispersion (CD-1b) was prepared in the same way as the charge control agent dispersion (CD-1a) except that dodecyl vinyl ether was substituted for the Moresco White MT-30P.

[Liquid Dispersion Developer Manufacturing Examples by Wet Pulverization Methods]

<Manufacturing Example of Liquid Developer (LD-1)>

36 parts of the polyester resin (PES-1), 9 parts of pigment blue 15:3 and 15 parts of Vylon UR-4800 (manufactured by Toyobo Co., Ltd., resin concentration 32%) were mixed thoroughly in a Henschel mixer. This was then melt kneaded with a co-rotating twin screw extruder with an internal roll heating temperature of 100° C., and the resulting mixture was cooled and coarsely pulverized d to obtain a coarsely-pulverized toner particle.

160 parts of Moresco White MT-30P (Moresco Corporation, SP value 7.90) as a carrier liquid, 40 parts of the coarsely-pulverized toner particle obtained above, and 1.2 parts of the toner particle dispersing agent (Dis-1) were then mixed for 24 hours in a sand mill to obtain a toner particle dispersion (T-1).

0.12 parts of the charge control agent dispersion (CD-1a) and 89.88 parts of Moresco White MT-30T were mixed with 10 parts of the toner particle dispersion (T-1) to obtain a liquid developer (LD-1).

<Manufacturing Examples of Liquid Developers (LD-2) to (LD-7)>

Liquid developers (LD-2) to (LD-7) were obtained as in the manufacturing example of the liquid developer (LD-1) except that the types of the polyester resin, toner particle dispersing agent and carrier liquid were changed as shown in Table 3.

<Manufacturing Examples of Liquid Developers (LD-8) to (LD-14)>

Liquid developers (LD-8) to (LD-14) were obtained as in the manufacturing example of the liquid developer (LD-1) except that the types of the polyester resin, toner particle dispersing agent and carrier liquid were changed as shown in Table 3, the charge control agent dispersion (CD-1a) was changed to the charge control agent dispersion (CD-1b), and 0.021 parts of (Example compound B-26) as a photopolymerization initiator and 0.035 parts of Kayacure-DETXS (2,4-diethylthioxanthone, manufactured by Nippon Kayaku Co., Ltd.) as a sensitizer were also added.

TABLE 3

| Liquid developer | Polyester resin | Toner particle dispersing agent | Carrier liquid | Manufacturing method | Acid groups/ Amino groups |
|---|---|---|---|---|---|
| LD-1 | PES-1 | Dis-1 | MT-30P | Wet pulverization | 6.0 |
| LD-2 | PES-2 | Dis-1 | MT-30P | Wet pulverization | 4.9 |
| LD-3 | PES-3 | Dis-1 | MT-30P | Wet pulverization | 1.7 |
| LD-4 | PES-2 | Dis-2 | MT-30P | Wet pulverization | 9.7 |
| LD-5 | PES-2 | Dis-3 | MT-30P | Wet pulverization | 8.7 |
| LD-6 | PES-4 | Dis-1 | MT-30P | Wet pulverization | 5.7 |
| LD-7 | PES-2 | Dis-5 | MT-30P | Wet pulverization | 4.9 |
| LD-8 | PES-1 | Dis-1 | DDVE | Wet pulverization | 6.0 |
| LD-9 | PES-2 | Dis-1 | DDVE | Wet pulverization | 4.9 |
| LD-10 | PES-3 | Dis-1 | DDVE | Wet pulverization | 1.7 |
| LD-11 | PES-2 | Dis-2 | DDVE | Wet pulverization | 9.7 |
| LD-12 | PES-2 | Dis-3 | DDVE | Wet pulverization | 8.7 |
| LD-13 | PES-2 | Dis-5 | DDVE | Wet pulverization | 4.9 |
| LD-14 | PES-2 | Dis-6 | DDVE | Wet pulverization | 5.5 |

In the table, DDVE represents dodecyl vinyl ether (SP value 8.13, volume resistivity $3.1\times10^{12}$ Ω·cm), and MT-30P represents Moresco White MT-30P (SP value 7.90, volume resistivity $8.4\times10^{12}$ Ω·cm).

"Coacervation" under manufacturing method represents a coacervation method.

"Acid groups/Amino groups" represents the ratio of the total number of acid groups in the polyester resin with an acid value of at least 5 mg KOH/g to the total number of amino groups in the polymer having the primary amino group.

<Manufacturing Examples of Comparative Liquid Developers (LD-101) to (LD-105)%

Comparative liquid developers (LD-101) to (LD-105) were obtained as in the manufacturing example of the liquid developer (LD-1) except that the types of the polyester resin, toner particle dispersing agent and carrier liquid were changed as shown in Table 4.

<Manufacturing Examples of Comparative Liquid Developers (LD-106) to (LD-110)>

Comparative liquid developers (LD-106) to (LD-110) were obtained as in the manufacturing example of the liquid developer (LD-1) except that the types of the polyester resin, toner particle dispersing agent and carrier liquid were changed as shown in Table 4, the charge control agent dispersion (CD-1a) was changed to the charge control agent dispersion (CD-1b), and 0.021 parts of (Example compound B-26) as a photopolymerization initiator and 0.035 parts of Kayacure-DETXS (2,4-diethylthioxanthone, manufactured by Nippon Kayaku Co., Ltd.) as a sensitizer were also added.

TABLE 4

| Comparative liquid developer | Polyester resin | Toner particle dispersing agent | Carrier liquid | Manufacturing method | Acid groups/ Amino groups |
|---|---|---|---|---|---|
| LD-101 | PES-5 | Dis-1 | MT-30P | Wet pulverization | 5.0 |
| LD-102 | FC-1565 | Dis-1 | MT-30P | Wet pulverization | 1.0 |

TABLE 4-continued

| Comparative liquid developer | Polyester resin | Toner particle dispersing agent | Carrier liquid | Manufacturing method | Acid groups/ Amino groups |
|---|---|---|---|---|---|
| LD-103 | PES-5 | Dis-3 | MT-30P | Wet pulverization | 8.9 |
| LD-104 | PES-5 | Dis-4 | MT-30P | Wet pulverization | 17.3 |
| LD-105 | PES-6 | Dis-1 | MT-30P | Wet pulverization | 0.2 |
| LD-106 | PES-5 | Dis-1 | DDVE | Wet pulverization | 5.0 |
| LD-107 | FC-1565 | Dis-1 | DDVE | Wet pulverization | 1.0 |
| LD-108 | PES-5 | Dis-3 | DDVE | Wet pulverization | 8.9 |
| LD-109 | PES-5 | Dis-4 | DDVE | Wet pulverization | 17.3 |
| LD-110 | PES-6 | Dis-1 | DDVE | Wet pulverization | 0.2 |

In tables 4 and 6, FC-1565 represent Diacron FC-1565 (polyester resin, acid value 6 mg KOH/g, manufactured by Mitsubishi Chemical Corporation).

[Liquid Developer Manufacturing Examples by Coacervation Methods]

<Manufacturing Example of Liquid Developer (LD-15)>

(Resin Dispersion Preparation Step)

30 parts of pigment blue 15:3, 47 parts of Vylon UR4800 (Toyobo Co., Ltd.), 255 parts of tetrahydrofuran and 130 parts of glass beads (di. 1 mm) were mixed, and dispersed for 3 hours with an attritor (manufactured by Nippon Coke & Engineering Co., Ltd.). This was then filtered with a mesh to remove the glass beads and obtain a dispersion.

180 parts of the resulting dispersion, 126 parts of a tetrahydrofuran solution (solids 50 mass %) of the polyester resin (PES-1) and 2.7 parts of the toner particle dispersion (Dis-1) were then mixed under stirring at 40° C. with a high-speed disperser (manufactured by Primix Corporation; T. K. Robomix/T. K. Homo Disper model 2.5) to obtain a resin-dispersed solution.

(Mixing Step)

70 parts of Moresco White MT-30P (Moresco Corporation, SP value 7.90) as a carrier liquid were added gradually to 100 parts of the resin-dispersed solution with a homogenizer (manufactured by IKA Works GmbH & Co. KG; Ultra-Turrax T50) under stirring at 25,000 rpm to prepare a liquid mixture.

(Distillation Step)

The resulting liquid mixture was transferred to a recovery flask, and the tetrahydrofuran was completely distilled off at 50° C. under ultrasound dispersion to obtain a toner particle dispersion.

(Liquid Developer Preparation Step)

0.12 parts of the charge control agent dispersion (CD-1a) and 89.88 parts of Moresco White MT-30T were mixed with 10 parts of the toner particle dispersion, to obtain a liquid developer (LD-15).

<Manufacturing Examples of Liquid Developers (LD-16) to (LD-21)>

Liquid developers (LD-16) to (LD-21) were obtained as in the manufacturing example of the liquid developer (LD-15) except that the types of the polyester resin, toner particle dispersing agent and carrier liquid were changed as shown in Table 5.

<Synthesis Examples of Liquid Developers (LD-22) to (LD-28)>

Liquid developers (LD-22) to (LD-28) were obtained as in the manufacturing example of the liquid developer (LD-15) except that the types of the polyester resin, toner particle dispersing agent and carrier liquid were changed as shown in Table 5, the charge control agent dispersion (CD-1a) was changed to the charge control agent dispersion (CD-1b), and 0.021 parts of (Example compound B-26) as a photopolymerization initiator and 0.035 parts of Kayacure-DETXS (2,4-diethylthioxanthone, manufactured by Nippon Kayaku Co., Ltd.) as a sensitizer were also added.

TABLE 5

| Liquid developer | Polyester resin | Toner particle dispersing agent | Carrier liquid | Manufacturing method | Acid groups/ Amino groups |
|---|---|---|---|---|---|
| LD-15 | PES-1 | Dis-1 | MT-30P | Coacervation | 6.0 |
| LD-16 | PES-2 | Dis-1 | MT-30P | Coacervation | 4.9 |
| LD-17 | PES-3 | Dis-1 | MT-30P | Coacervation | 1.7 |
| LD-18 | PES-2 | Dis-2 | MT-30P | Coacervation | 9.7 |
| LD-19 | PES-2 | Dis-3 | MT-30P | Coacervation | 8.7 |
| LD-20 | PES-4 | Dis-1 | MT-30P | Coacervation | 5.7 |
| LD-21 | PES-2 | Dis-5 | MT-30P | Coacervation | 4.9 |
| LD-22 | PES-1 | Dis-1 | DDVE | Coacervation | 6.0 |
| LD-23 | PES-2 | Dis-1 | DDVE | Coacervation | 4.9 |
| LD-24 | PES-3 | Dis-1 | DDVE | Coacervation | 1.7 |
| LD-25 | PES-2 | Dis-2 | DDVE | Coacervation | 9.7 |
| LD-26 | PES-2 | Dis-3 | DDVE | Coacervation | 8.7 |
| LD-27 | PES-2 | Dis-5 | DDVE | Coacervation | 4.9 |
| LD-28 | PES-2 | Dis-6 | DDVE | Coacervation | 5.5 |

<Manufacturing Examples of Comparative Liquid Developers (LD-111) to (LD-115)>

Liquid developers (LD-111) to (LD-115) were obtained as in the manufacturing example of the liquid developer (LD-15) except that the types of the polyester resin, toner particle dispersing agent and carrier liquid were changed as shown in Table 6.

<Manufacturing Examples of Comparative Liquid Developers (LD-116) to (LD-120)>

Comparative liquid developers (LD-116) to (LD-120) were obtained as in the manufacturing example of the liquid developer (LD-15) except that the types of the polyester resin, toner particle dispersing agent and carrier liquid were changed as shown in Table 6, the charge control agent dispersion (CD-1a) was changed to the charge control agent dispersion (CD-1b), and 0.021 parts of (Example compound B-26) as a photopolymerization initiator and 0.035 parts of Kayacure-DETXS (2,4-diethylthioxanthone, manufactured by Nippon Kayaku Co., Ltd.) as a sensitizer were also added.

TABLE 6

| Comparative liquid developer | Polyester resin | Toner particle dispersing agent | Carrier liquid | Manufacturing method | Acid groups/ Amino groups |
|---|---|---|---|---|---|
| LD-111 | PES-5 | Dis-1 | MT-30P | Coacervation | 5.0 |
| LD-112 | FC-1565 | Dis-1 | MT-30P | Coacervation | 1.0 |
| LD-113 | PES-5 | Dis-3 | MT-30P | Coacervation | 8.9 |
| LD-114 | PES-5 | Dis-4 | MT-30P | Coacervation | 17.3 |
| LD-115 | PES-6 | Dis-1 | MT-30P | Coacervation | 0.2 |
| LD-116 | PES-5 | Dis-1 | DDVE | Coacervation | 5.0 |
| LD-117 | FC-1565 | Dis-1 | DDVE | Coacervation | 1.0 |
| LD-118 | PES-5 | Dis-3 | DDVE | Coacervation | 8.9 |
| LD-119 | PES-5 | Dis-4 | DDVE | Coacervation | 17.3 |
| LD-120 | PES-6 | Dis-1 | DDVE | Coacervation | 0.2 |

<Evaluation of Liquid Developers>

The liquid developers (LD-1) to (LD-28) (hereunder called the examples) and (LD-101) to (LD-120) (hereunder called the comparative examples) were evaluated by the following methods.

<Evaluating Toner Particle Diameter>

The volume-based 50% particle diameter (D50) [unit: μm] of the toner particle in each liquid developer was measured using a laser diffraction/scattering particle size distribution analyzer (product name: LA-950, manufactured by Horiba, Ltd.).

The evaluation standard is shown below.

5: (D50)≤1.0
4: 1.0<(D50)≤1.2
3: 1.2<(D50)≤2.0
2: 2.0<(D50)≤3.0
1: 3.0<(D50)

The evaluation results are shown in Tables 7-1 to 7-4.

<Evaluating Dispersion Stability of Toner Particle>

The volume-based 50% particle diameter (D50) [unit: μm] of the toner particle in each liquid developer immediately after manufacture and two months after manufacture was measured using a laser diffraction/scattering particle size distribution analyzer (product name: LA-950, manufactured by Horiba, Ltd.).

The ratio ($D50_2/D50_0$) of the D50 after two months ($D50_2$) to the D50 of the liquid developer immediately after manufacture (D500) was also calculated.

The evaluation standard is shown below.

5: ($D50_2/D50_0$)≤1.1
4: 1.1<($D50_2/D50_0$)≤1.2
3: 1.2<($D50_2/D50_0$)≤1.5
2: 1.5<($D50_2/D50_0$)≤2.0
1: 2.0<($D50_2/D50_0$)

The evaluation results are shown in Tables 7-1 to 7-4.

<Evaluating Volume Resistivity>

The volume resistivity of the liquid developer measured by the above methods.

The evaluation standard is shown below.

5: $5\times10^9$ Ωcm≤(Volume resistivity)
4: $1\times10^9$ Ωcm≤(Volume resistivity)<$5\times10^9$ Ωcm
3: $5\times10^8$ Ωcm≤(Volume resistivity)<$1\times10^9$ Ωcm
2: $1\times10^8$ Ωcm≤(Volume resistivity)<$5\times10^8$ Ωcm
1: (Volume resistivity)<$1\times10^8$ Ωcm The evaluation results are shown in Tables 7-1 to 7-4.

<Evaluating Developing Performance>

Images were developed by the following methods using the above liquid developers. The developing apparatus 50C shown in FIG. 1 was used as the equipment.

(1) With gaps between developing roller 53C, photosensitive drum 52C and intermediate transfer roller 61C, these were rotated in the directions shown by the arrows in FIG. 1 without contacting one another. The rotational speed at this time was 250 mm/sec.

(2) Developing roller 53C and photosensitive drum 52C were brought into contact under constant pressure, and the bias was set to 200 V using a DC power source.

(3) Photosensitive drum 52C and intermediate transfer roller 61C were brought into contact under constant pressure, and the transfer bias was set to 1,000 V using a DC power source.

(4) A uniform density (toner particle density 2 mass %) and uniform amount (100 mL) of the liquid developer was supplied to a film-forming roller (not shown), and the image formed on the intermediate transfer member 60C was evaluated.

The evaluation standard for developing performance is shown below.

5: High-density, high-definition image obtained
4: Slight density irregularity and image blurring observed
3: Obvious density irregularity and image blurring, but image developed
2: Severe density irregularity and image blurring, insufficient development
1: Not developed The evaluation results are shown in Tables 7-1 to 7-4.

TABLE 7-1

| Liquid developer | Particle diameter | Dispersion stability | Volume resistivity | Developing performance |
|---|---|---|---|---|
| LD-1 | 5 | 5 | 5 | 5 |
| LD-2 | 4 | 5 | 5 | 5 |
| LD-3 | 3 | 5 | 5 | 4 |
| LD-4 | 4 | 5 | 4 | 4 |
| LD-5 | 4 | 5 | 4 | 4 |
| LD-6 | 5 | 5 | 3 | 3 |
| LD-7 | 3 | 5 | 3 | 3 |
| LD-7 | 3 | 3 | 5 | 3 |
| LD-8 | 5 | 5 | 5 | 5 |
| LD-9 | 4 | 5 | 5 | 5 |
| LD-10 | 3 | 5 | 5 | 4 |
| LD-11 | 4 | 5 | 4 | 4 |
| LD-12 | 4 | 5 | 4 | 4 |
| LD-13 | 3 | 3 | 5 | 3 |
| LD-14 | 5 | 5 | 5 | 5 |

TABLE 7-2

| Liquid developer | Particle diameter | Dispersion stability | Volume resistivity | Developing performance |
|---|---|---|---|---|
| LD-15 | 5 | 5 | 5 | 5 |
| LD-16 | 4 | 5 | 5 | 5 |
| LD-17 | 3 | 5 | 5 | 4 |
| LD-18 | 4 | 5 | 4 | 4 |
| LD-19 | 4 | 5 | 4 | 4 |
| LD-20 | 5 | 5 | 3 | 3 |
| LD-20 | 3 | 5 | 3 | 3 |
| LD-21 | 3 | 3 | 5 | 3 |
| LD-22 | 5 | 5 | 5 | 5 |
| LD-23 | 4 | 5 | 5 | 5 |
| LD-24 | 3 | 5 | 5 | 4 |
| LD-25 | 4 | 5 | 4 | 4 |
| LD-26 | 4 | 5 | 4 | 4 |
| LD-27 | 3 | 3 | 5 | 3 |
| LD-28 | 5 | 5 | 5 | 5 |

TABLE 7-3

| Comparative liquid developer | Particle diameter | Dispersion stability | Volume resistivity | Developing performance |
|---|---|---|---|---|
| LD-101 | 5 | 5 | 2 | 2 |
| LD-102 | 3 | 2 | 2 | 2 |
| LD-103 | 5 | 5 | 1 | 1 |
| LD-104 | 5 | 5 | 1 | 1 |
| LD-105 | 1 | 1 | 1 | 1 |
| LD-106 | 5 | 5 | 2 | 2 |
| LD-107 | 3 | 2 | 2 | 2 |
| LD-108 | 5 | 5 | 1 | 1 |
| LD-109 | 5 | 5 | 1 | 1 |
| LD-110 | 1 | 1 | 1 | 1 |

TABLE 7-4

| Comparative liquid developer | Particle diameter | Dispersion stability | Volume resistivity | Developing performance |
|---|---|---|---|---|
| LD-111 | 5 | 5 | 2 | 2 |
| LD-112 | 3 | 2 | 2 | 2 |
| LD-113 | 5 | 5 | 1 | 1 |
| LD-114 | 5 | 5 | 1 | 1 |
| LD-115 | 1 | 1 | 1 | 1 |
| LD-116 | 5 | 5 | 2 | 2 |
| LD-117 | 3 | 2 | 2 | 2 |
| LD-118 | 5 | 5 | 1 | 1 |

TABLE 7-4-continued

| Comparative liquid developer | Particle diameter | Dispersion stability | Volume resistivity | Developing performance |
|---|---|---|---|---|
| LD-119 | 5 | 5 | 1 | 1 |
| LD-120 | 1 | 1 | 1 | 1 |

With the present invention, it is possible to provide a liquid developer having high volume resistivity of the liquid developer and containing a toner particle with a small particle diameter and excellent dispersion stability, along with a method for manufacturing the liquid developer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A liquid developer, comprising:

a carrier liquid with an SP value of not more than 8.20;

a toner particle that is insoluble in the carrier liquid, the toner particle containing a polyester resin with an acid value of 5 to 50 mg KOH/g and having a number-average molecular weight of 3,500 to 20,000, the polyester resin containing a monomer unit derived from an alcohol component and a monomer unit derived from an acid component; and a toner particle dispersing agent, the toner particle dispersing agent being a polymer having a primary amino group and having an amine value of 30 to 200 mg KOH/g, wherein a ratio of a total number of acid groups in the polyester resin relative to a total number of amino groups in the polymer having the primary amino group is 1.0 to 10.0, the monomer unit derived from the alcohol component includes a monomer unit derived from a $C_{2-12}$ aliphatic diol, and a content of the monomer units derived from the $C_{2-12}$ aliphatic diol as a percentage of the monomer units derived from the alcohol component is 40 to 100 mol %, and the monomer unit derived from the acid component includes a monomer unit derived from a $C_{8-12}$ aromatic dicarboxylic acid, and a content of the monomer units derived from the aromatic dicarboxylic acid having 8 to 12 carbon atoms as a percentage of the monomer units derived from the acid component is 75 to 100 mol %.

2. The liquid developer according to claim 1, wherein the polymer having the primary amino group is a polyallylamine derivative having monomer units represented by formulae (4) and (6) in one polymer

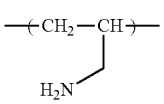

(4)

-continued

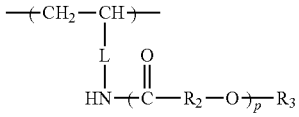

(6)

where R2 is an optionally substituted alkylene group having at least 6 carbon atoms or optionally substituted cycloalkylene group having at least 6 carbon atoms, $R_3$ is hydrogen or —C(=O)—$R_4$, in which $R_4$ is an optionally substituted alkyl group having at least 6 carbon atoms or optionally substituted cycloalkyl group having at least 6 carbon atoms, p represents an integer of at least 1, and L is a divalent linking group.

3. The liquid developer according to claim 2, wherein the polymer having the primary amino group is a reaction product of polyallylamine with a self-condensate of 12-hydroxystearic acid.

4. The liquid developer according to claim 1, wherein the acid value of the polyester resin is 20 to 50 mg KOH/g.

5. The liquid developer according to claim 1, wherein the amine value of the polymer having the primary amino group is 60 to 200 mg KOH/g.

6. The liquid developer according to claim 1, wherein the carrier liquid is a vinyl ether compound, and the liquid developer also contains a photopolymerization initiator.

7. A method for manufacturing the liquid developer according to claim 1, comprising:

a step (i) of preparing a resin-dispersed solution containing a polyester resin with an acid value of 5 to 50 mg KOH/g, a polymer having a primary amino group and an amine value of 30 to 200 mg KOH/g, and a solvent that dissolves the polyester resin;

a step (ii) of preparing a mixture containing the resin-dispersed solution and a carrier liquid with an SP value of not more than 8.20; and a step (iii) of distilling off the solvent from the mixture.

8. A method for manufacturing the liquid developer according to claim 1, comprising:

a step (I) of preparing a resin-dispersed solution containing a polyester resin with an acid value of 5 to 50 mg KOH/g, a polymer having a primary amino group and an amine value of 30 to 200 mg KOH/g, and a solvent that dissolves the polyester resin;

a step (II) of preparing a first mixture containing the resin-dispersed solution and a solvent other than a carrier liquid with an SP value of not more than 8.20 that does not dissolve the polyester resin;

a step (III) of removing the solvent that dissolves the polyester resin from the first mixture to prepare a toner particle dispersion; and a step (IV) of preparing a second mixture containing the toner particle dispersion and the carrier liquid.

* * * * *